US007004467B2

(12) United States Patent
Lo

(10) Patent No.: US 7,004,467 B2
(45) **Date of Patent: *Feb. 28, 2006**

(54) CARD GAME

(76) Inventor: Henry Tien Lo, 5010 Indian River Dr., #32, Las Vegas, NV (US) 89103

( * ) Notice: Subject to any disclaimer, the term of this patent is extended or adjusted under 35 U.S.C. 154(b) by 0 days.

This patent is subject to a terminal disclaimer.

(21) Appl. No.: 10/431,044

(22) Filed: May 6, 2003

(65) Prior Publication Data

US 2003/0197331 A1 Oct. 23, 2003

Related U.S. Application Data

(63) Continuation-in-part of application No. 09/823,569, filed on Mar. 29, 2001, now Pat. No. 6,575,465, which is a continuation-in-part of application No. 09/315,295, filed on May 20, 1999, now Pat. No. 6,402,147.

(60) Provisional application No. 60/430,840, filed on Dec. 3, 2002, provisional application No. 60/398,387, filed on Jul. 24, 2002, provisional application No. 60/378,128, filed on May 14, 2002, provisional application No. 60/378,090, filed on May 14, 2002, provisional application No. 60/193,309, filed on Mar. 30, 2000.

(51) Int. Cl.
*A63F 11/00* (2006.01)

(52) U.S. Cl. ..... 273/292; 273/274; 273/309; 463/10; 463/12; 463/13

(58) Field of Classification Search ..... 273/292, 273/274, 309; 463/10–13
See application file for complete search history.

(56) References Cited

U.S. PATENT DOCUMENTS

| | | | | |
|---|---|---|---|---|
| 5,863,042 | A * | 1/1999 | Lo | 273/292 |
| 5,984,310 | A * | 11/1999 | English | 273/292 |
| 6,019,374 | A * | 2/2000 | Breeding | 273/292 |
| 6,102,402 | A * | 8/2000 | Scott et al. | 273/292 |
| 6,402,147 | B1 * | 6/2002 | Lo | 273/292 |
| 6,575,465 | B1 * | 6/2003 | Lo | 273/292 |

* cited by examiner

*Primary Examiner*—Gregory Vidovich
*Assistant Examiner*—Dolores R. Collins
(74) *Attorney, Agent, or Firm*—Elman Technology Law, P.C.; Gerry J. Elman

(57) ABSTRACT

The present invention is a seven-card-stud poker game, played with at least one standard poker deck of 52 cards, plus at least one Joker. Two or more players may participate in the game. One of the players is the Banker whom other players play against. A Player who is not a Banker may place a Poker Bet wager and/or a Pair Of Aces Or Better Bet wager; after at least one of two said wagers is placed, the Player has the option to place a Bonus Bet wager. Subsequently each Player and the Banker are each dealt seven cards, and then the Players and the Banker each then selects and keeps his or her best 5-card poker hand and discards two other cards from his or her own seven cards. To win a Poker Bet wager, a Player's best 5-card poker hand must rank higher than the Banker's best 5-card poker hand. To win a Pair Of Aces Or Better Bet wager, a Player's best 5-card poker hand must be a pair of Aces or better. To win a Bonus Bet wager, a Player must be dealt a 7-Card Straight Flush or a Player's best 5-card poker hand must rank higher than the Banker's with Flush or better. Three said wagers are independent wagers and are settled separately.

21 Claims, 3 Drawing Sheets

CARD GAME

CROSS REFERENCE TO RELATED APPLICATION

This application is a continuation-in-part of application Ser. No. 09/823,569, filed Mar. 29, 2001, now U.S. Pat. No. 6,575,465 and claims the benefit of 60/193,309 filed Mar. 30, 2000, which is a continuation-in-part of application Ser. No. 09/315,295, filed May 20, 1999, now U.S. Pat. No. 6,402,147 B1, and claims the benefits under 35 U.S.C. §119(e) from the following provisional patent applications: Ser. No. 60/378,090, filed May 14, 2002; 60/378,128, filed May 14, 2002; 60/398,387, filed Jul. 24, 2002; and 60/430, 840, filed Dec. 3, 2002.

SUMMARY OF THE INVENTION

The present invention generally relates to card games and, in particular, to card games for use in casinos and cardrooms.

Pai Gow Poker, a seven-card stud poker game, is getting more and more popular in casinos across the country every day. Players who loves Pai Gow Poker found the game is simple enough and provides them seven cards for reading enjoyment as well as relaxation. Yet, many players are disgruntled with its adverse features—collecting 5% commission of all winning wagers and the copy-hand rules in which the Banker wins all same ranking hands; while some casinos find the game too slow, not profitable. Commonly owned U.S. patent application Ser. No. 09/823,569 and U.S. Pat. No. 6,402,147 B1 to Lo are invented to overcome these disadvantages of Pai Gow Poker. Besides eliminating both 5% commission thing and the copy-hand rules, they simplifies the dealing procedure and the rules of play of Pai Gow Poker. However, two said games offers players an excessive number of bets, which could confuse the players every time they make a betting decision, but not enough choices in settling wagers of the primary bets to meet the particular need of each casino. The present invention is devised to solve these problems.

SUMMARY OF THE INVENTION

The present invention is a seven-card-stub poker game, played with at least one standard poker deck of 52 cards plus at least one 'Joker.' The Joker either is 'wild' and can be used as any card or is 'semi-wild' and can be used as an Ace or to form a Straight or Flush. Two or more players, preferably seven players, may participate in the game. One of the players is the Banker whom other players play against. A Player who is not a Banker may make a Poker Bet wager playing against the Banker's hand and/or a Pair Of Aces Or Better Bet wager; after at least one of two said wagers is placed, the Player has an option to make a Bonus Bet wager.

Once at least one wager is placed, every Player and the Banker are each dealt seven cards. From each Player's seven cards, each Player selects and keeps his or her best 5-card poker hand and discards two other cards. From the Banker's seven cards, the Banker selects and keeps the Banker's best 5-card poker hand and discards two other cards.

POKER BET: Poker Bet is a bet that allows a Player to place a wager playing against a Banker's hand. The object of Poker bet is to have a best 5-card poker hand that outranks the opponent's best 5-card poker hand. In the Poker Bet game, a Player's best 5-card poker hand is compared to the Banker's best 5-card poker hand according to either one of two following traditional poker rankings, whichever is applicable: (1) The rankings under the rules that the Joker is wild and can be used as any card, wherein hands are ranked in descending order as follows: 5 of a Kind, Royal Flush, Straight Flush, 4 of a Kind, Full House, Flush, Straight, 3 of a Kind, Two Pair, One Pair and High Card; wherein A2345 is the lowest Straight and that it is suited, A2345 is the lowest Straight Flush. (2) The rankings under the rules that the Joker is semi-wild and can be used as an Ace or to form a Straight or Flush, wherein hands are ranked in descending order as follows: 5 Ace, Royal Flush, Straight Flush, 4 of a Kind, Full House, Flush, Straight, 3 of a Kind, Two Pair, One Pair and High Card; wherein A2345 is the second highest Straight and that it is suited, A2345 is the second highest Straight Flush.

A Poker Bet wager may be settled according to any one of eighteen sets of rules. And below are two of them:

If the Banker's hand (best 5-card poker hand) is not a qualifying hand of Ace-high or better (i.e. a hand consisting of A8765 is an Ace-high hand, and a hand consisting of 55KQJ is a better hand than the Ace-high hand), the Player's wager wins and is paid one half of the wager (1 to 2) even the Player's hand (best 5-card poker hand) ranks lower than the Banker's; if the Player's hand ranks lower than the Banker's and the Banker's hand is a qualifying hand of Ace-high or better, the Player's wager loses; if the Player's hand ranks higher than or ranks the same as the Banker's and the Banker's hand is a qualifying hand of Ace-high or better, the Player's wager wins and is paid Even Money (1 to 1).

If the Banker's hand is not one of the predetermined qualifying hands, the Player's wager wins and is paid one half of the wager (1 to 2) even the Player's hand ranks lower than the Banker's; if the Player's hand ranks lower than the Banker's and the Banker's hand is one of the predetermined qualifying hands, the Player's wager loses; if the Player's hand ranks higher than or ranks the same as the Banker's and the Banker's hand is one of the predetermined qualifying hands, the Player's wager wins and is paid according to a predetermined pay table.

PAIR OF ACES OR BETTER BET under the rules of that the Joker is 'wild' and can be used as any card: A Player's Pair Of Aces Or Better Bet wager wins if the Player's hand ranks higher than or ranks the same as the Banker's with a pair of Aces, Two Pair, 3 of a Kind, Straight, Flush, Full House, 4 of a Kind, Straight Flush, Royal Flush or 5 of a Kind, and is paid according to a predetermined pay table; the Player's wager loses if the Player's hand ranks lower than the Banker's or if the Player's hand ranks higher than or ranks the same as the Banker's with a pair of Kings or lower.

PAIR OF ACES OR BETTER BET under the rules of that the Joker is 'semi-wild' and can be used as an Ace or to complete a Straight or Flush: A Player's Pair Of Aces Or Better Bet wager wins if the Player's hand is a pair of Aces, Two Pair, 3 of a Kind, Straight, Flush, Full House, 4 of a Kind, Straight Flush, Royal Flush or 5 Aces; and the Player's wager loses if the Player's hand is not one of the above winning hands. The player's winning wager may be paid according to one of predetermined pay tables such as the following pay table, which yields a house advantage of 2.77%:

| Hand | Payout Odds |
|---|---|
| 5 Aces | 50 to 1 |
| Royal Flush | 20 to 1 |
| Straight Flush | 7 to 1 |

-continued

| Hand | Payout Odds |
|---|---|
| 4 of a Kind | 6 to 1 |
| Full House | 2 to 1 |
| Aces through Flush | 1 to 1 |

BONUS BET under the rules that the Joker is 'wild' and can be used as any card. A Bonus Bet wager may be settled according to one of many sets of rules; and below is one of them: A Player's Bonus Bet wager wins if the Player is dealt a 7-Card Straight Flush or if the Player's hand (best 5-card poker hand) ranks higher than the Banker's hand (best 5-card poker hand) with Flush or better (Full House, 4 of a Kind, Straight Flush, Royal Flush or 5 of a Kind); and the Player's wager loses if the Player's hand ranks the same as or ranks lower than the Banker's or if the Player's hand ranks higher than the Banker's with Straight or lower; the Player's winning wager may be paid according to one of predetermined pay tables such as the following pay table, which yields a house advantage of 22,27%:

| Hand | Payout Odds |
|---|---|
| 7 Card Straight Flush With No Joker | 20,000 to 1 |
| 7 Card Straight Flush With Joker | 5,000 to 1 |
| 5 of a Kind | 500 to 1 |
| Royal Flush | 400 to 1 |
| Straight Flush | 75 to 1 |
| 4 of a Kind | 30 to 1 |
| Full House | 4 to 1 |
| Flush | 3 to 1 |

BONUS BET under the rules that the Joker is 'semi-wild' and can be used as an Ace or to form a Straight or Flush. A Bonus Bet wager may be settled according to one of many sets of rules; and below is one of them: A Player's Bonus Bet wager wins if the Player is dealt a 7-Card Straight Flush or if the Player's hand ranks higher than the Banker's with Flush or better (Full House, 4 of a Kind, Straight Flush, Royal Flush or 5 Aces); and the Player's wager loses if the Player's hand ranks the same as or ranks lower than the Banker's, or if the Player's hand ranks higher than the Banker's with Straight or lower; the Player's winning wager may be paid according to one of predetermined pay tables such as the following pay table, which yields a house advantage of 22.26%:

| Hand | Payout Odds |
|---|---|
| 7 Card Straight Flush With No Joker | 20,000 to 1 |
| 7 Card Straight Flush With Joker | 10,000 to 1 |
| 5 Aces | 5,000 to 1 |
| Royal Flush | 500 to 1 |
| Straight Flush | 200 to 1 |
| 4 of a Kind | 75 to 1 |
| Full House | 4 to 1 |
| Flush | 2 to 1 |

After reading their cards, each Player places his or her cards face up on the appropriate spaces of the table layout. The dealer then reveals the Banker's six remaining cards, selects and keeps the Banker's best 5-card poker hand and discards two other cards, and settles each Player's Pair Of Aces Or Better Bet wager first if any, then each Player's Poker Bet wager if any, and each Player's Bonus Bet wager last if any, against the Banker.

The objective of the present invention is to provide players a thrilling, enjoyable and relaxing gaming experience, while giving casinos a fair return on investment.

It is an advantage of the present invention that it reduces an excessive number of side bets the co-pending application Ser. No. 09/823,569 offers from 6 to 2, while enhancing the appeal of the payout of two said side bets.

It is also an advantage of the present invention that it features two Even-Money-Payout games designed to enable players winning more often and having more fun, and one Jackpot-Payout game designed to enable players betting a little and being able to win a bundle.

It is another advantage of the present invention that it balances the house advantage—great enough to give a casino a fair return on investment while no so large to give players the sense of winning.

It is a feature of the present invention that it provides casinos a great number of sets of rules to choose from and to meets their particular need.

It is also a feature of the present invention that it offers players seven cards for reading enjoyment.

It is another feature of the present invention that It is a rapid-wager-resolution game.

It is also another feature of the present invention that it gives most of the players who have played it truly a thrilling, enjoyable, and relaxing experience due to the advantages and features mentioned above.

Other advantages and features of the present invention will be apparent from the detailed description of the invention, the accompanying drawings and the appended claims.

DETAILED DESCRIPTION OF THE INVENTION

Figure 1:
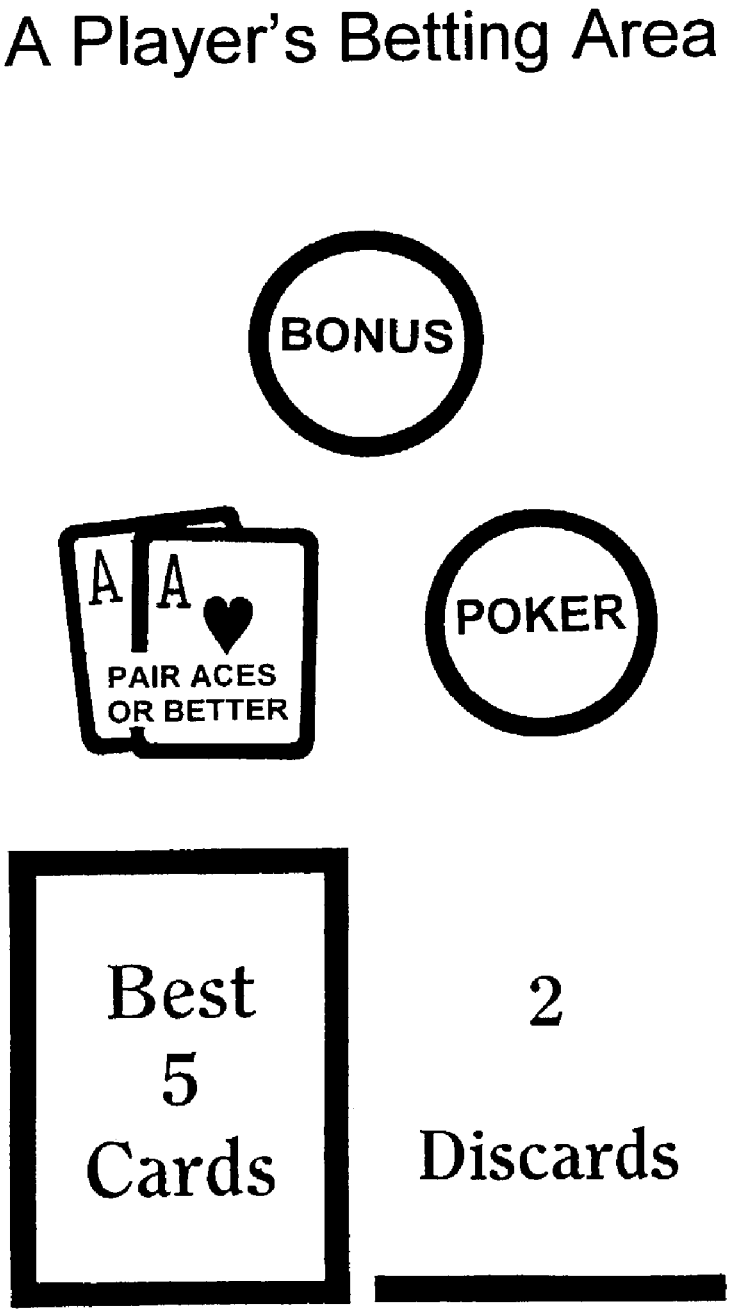
FIG. 1 shows a Player's betting area of the table layout of the present invention: The double squares marked 'Pair Aces Or Better' is a Pair Of Aces Or Better Bet spot; the circle marked 'Bonus' is a Bonus Bet spot; the circle marked 'Poker' is a Poker Bet spot; the big square marked 'Best 5 Cards' is a Player's best 5-card poker hand space; and the area marked '2 Discards' is a Player's two discards space.
Figure 2:
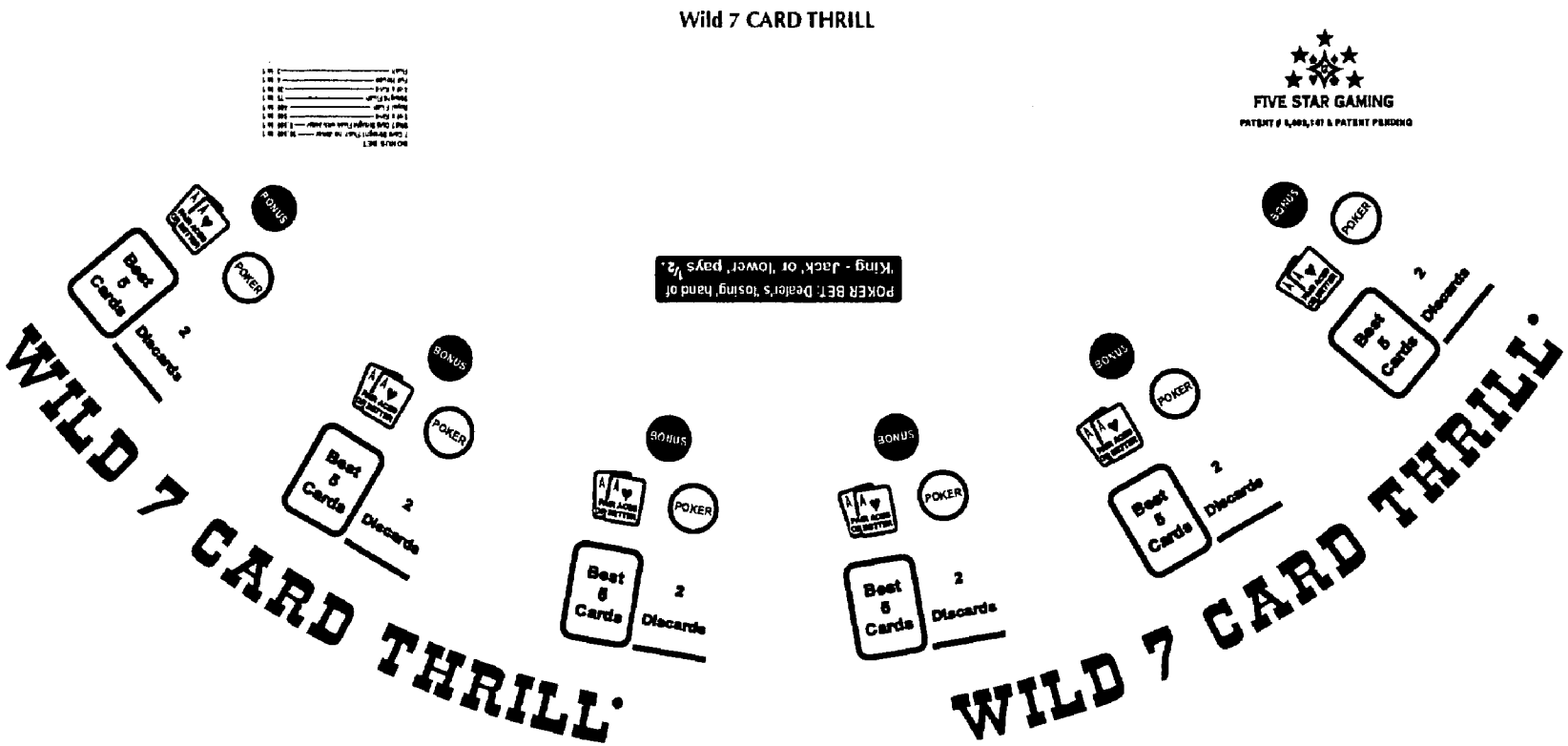
FIG. 2 shows the table layout of the joker-wild version of the present invention, called "Wild 7 Card Thrill", wherein the Joker is 'wild' and can be used as any card.
Figure 3:
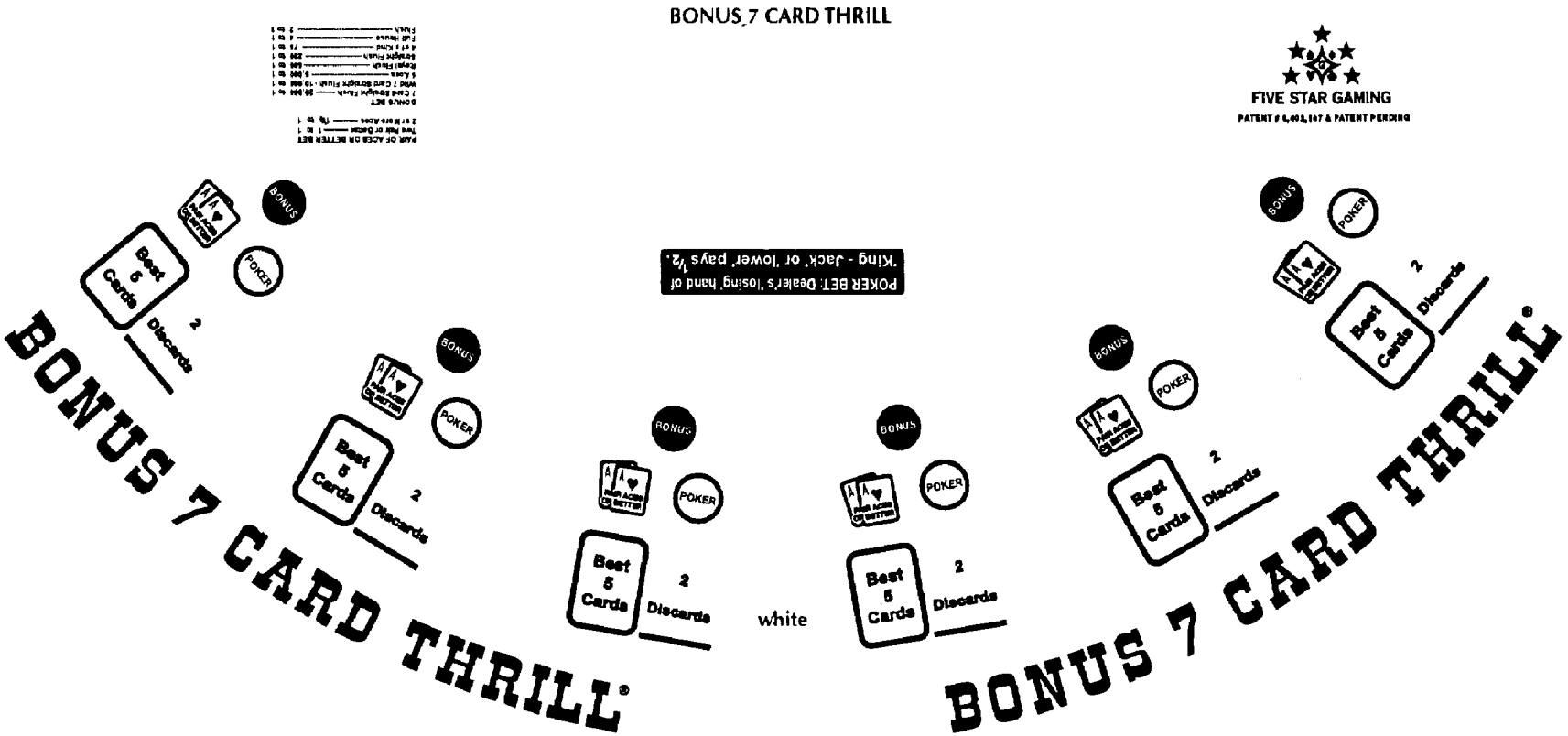
FIG. 3 shows the table layout of the joker-semi-wild version of the present invention, called "Bonus 7 Card Thrill", wherein the Joker is 'semi-wild' and can be used as an Ace or to form a Straight or Flush.

In the preferred embodiment of the invention is a seven-card stud poker game, played with one standard poker deck of 52 cards plus one Joker. Other embodiments include versions that would be played with at least one standard poker deck of 52 cards plus at least one Joker. In thirteen other embodiments, the invention is played with at least one standard poker deck of 52 cards, wherein either all Twos, all Threes, all Fours, all Fives, all Sixes, all Sevens, all Eights, all Nines, all Tens, all Jacks, all Queens, all Kings, or all Aces are Wild Cards. In an embodiment, the invention is played with at least one standard poker deck of 52 cards.

In the preferred embodiment, each Joker or each Wild Card can be used as any card. In another preferred embodiment, each Joker or each Wild Card can be used as an Ace, or to form a Straight or Flush.

In the preferred embodiment, the present invention offers seven positions, six Players and one Banker; table size, management of players, players' bets, and speed of play are the key reasons for the choice of seven positions. In other embodiments, lesser or greater than seven positions can be created in accordance with this invention if, for example, multiple decks are used. A Player who is not a Banker may place a Poker Bet wager playing against the Banker's hand and/or Pair Of Aces Or Better Bet wager; after at least one of two said wagers is placed, the Player has an option to place a Bonus Bet wager.

After at least one wager is placed, each Player and the Banker are each dealt seven cards. In the preferred embodiment, every Player and the Banker each receives his or her own seven-card dealt hand either at one time or proportionally, starting from the Player sitting to the immediate left of the dealer, continuing in a clockwise fashion and ending with the Banker; cards are preferably dealt to each Player and to the Banker one card at a time for seven times if the cards are shuffled by a dealer; and the cards are preferably dealt to each Player and to the Banker in a stack of seven cards if the cards are shuffled by a shuffling device. In an embodiment, seven or eight hands of seven cards are always dealt, regardless of the actual number of players; and some random number generation device such as a random number generator display or a dice shaker, is used to assign the dealt hands to players to reduce the likelihood of problems in dealing. In other embodiments, every Player and the Banker will receive their hand in either one of the following fashions:

1. They receive their own six cards and one community card.
2. They receive their own five cards and two community cards.
3. They receive their own four cards and three community cards.
4. They receive their own three cards and four community cards.
5. They receive their own two cards and five community cards.
6. They receive their own one card and six community cards. And
7. They receive no card their own and seven community cards.

Once the dealer has delivered the cards to all players, the dealer turns over the Banker's seven cards with only the top card exposed. Each Player selects and keeps his or her best 5-card poker hand, discards two other cards, and then places the cards either face up or face down on the appropriate spaces of the table layout. The dealer then reveals the Banker's six remaining cards, selects and keeps the Banker's best 5-card poker hand, discards two other cards, opens the cards of the Player at the immediate right of the dealer, and settles the Player's Pair Of Aces Or Better Bet wager first if any, then the Player's Poker Bet wager if any, and the Player's Bonus Bet wager last if any, against the Banker. After completing the transaction of the Player at the immediate right of the dealer, the dealer moves on and completes the transaction of the next Player, and so on. Upon the completion of all transactions, a new round of play will begin.

POKER BET: Poker Bet is a bet that allows a Player to place a wager playing against a Banker's hand. The object of Poker bet is to have a best 5-card poker hand that outranks the opponent's best 5-card poker hand. In the Poker Bet game, a Player's best 5-card poker hand is compared to the Banker's best 5-card poker hand according to either one of two following traditional poker rankings, whichever is applicable: (1) The rankings under the rules that the Joker is wild and can be used as any card, wherein hands are ranked in descending order as follows: 5 of a Kind, Royal Flush, Straight Flush, 4 of a Kind, Full House, Flush, Straight, 3 of a Kind, Two Pair, One Pair and High Card; Ace is the highest High Card, following by King, Queen, Jack, Ten, 9, 8, 7, 6, 5, 4, 3 and 2; wherein A2345 is the lowest Straight and that it is suited, A2345 is the lowest Straight Flush, or wherein A2345 is the second highest Straight and that it is suited, A2345 is the second highest Straight Flush, whichever is chosen. (2) The rankings under the rules that the Joker is semi-wild and can be used as an Ace or to form a Straight or Flush, wherein hands are ranked in descending order as follows: 5 Ace, Royal Flush, Straight Flush, 4 of a Kind, Full House, Flush, Straight, 3 of a Kind, Two Pair, One Pair and High Card; Ace is the highest High Card, following by King, Queen, Jack, Ten, 9, 8, 7, 6, 5, 4, 3 and 2; wherein A2345 is the second highest Straight and that it is suited, A2345 is the second highest Straight Flush, or wherein A2345 is the lowest Straight and that it is suited, A2345 is the lowest Straight Flush, whichever is chosen.

A Poker Bet wager, under either the rules of that the Joker is 'wild' and can be used as any card, or the rules of that the Joker is 'semi-wild' can be used as an Ace or to form a Straight or Flush, can be settled according to either one of the following eighteen rules:

Rules 1: If the Banker's hand (best 5-card poker hand) is not a qualifying hand of Ace-high or better (i.e. a hand consisting of A8765 is an Ace-high hand, and a hand consisting of 55KQJ is a better hand than the Ace-high hand), the Player's Poker Bet wager wins and is paid one half of the wager (1 to 2) even the Player's hand (best 5-card poker hand) ranks lower than the Banker's hand (best 5-card poker hand); if the Player's hand ranks lower than the Banker's and the Banker's hand is a qualifying hand of Ace-high or better, the Player's wager loses; if the Player's hand ranks higher than or ranks the same as the Banker's and the Banker's hand is a qualifying hand of Ace-high or better, the Player's wager wins and is paid Even Money (1 to 1).

Rules 2: If the Banker's hand is not one of the predetermined qualifying hands, the Player's Poker Bet wager wins and is paid one half of the wager (1 to 2) even the Player's hand ranks lower than the Banker's; if the Player's hand ranks lower than the Banker's and the Banker's hand is one of the predetermined qualifying hands, the Player's wager loses; if the Player's hand ranks higher than or ranks the same as the Banker's and the Banker's hand is one of the predetermined qualifying hands, the Player's wager wins and is paid either Even Money (1 to 1) or according to a predetermined pay table, whichever is chosen for this Poker Bet.

Rules 3: If the Banker's hand is not one of the predetermined qualifying hands (such as one of the qualifying hands of King-high or better, one of the qualifying hands of Ace-high or better, etc.), the Player's Poker Bet wager wins and is paid one half of the wager (1 to 2) even the Player's hand ranks lower than the Banker's; if the Player's hand ranks lower than the Banker's and the Banker's hand is one of the predetermined qualifying hands, the Player's wager loses; if the Player's ranks the same as the Banker's and the Banker's hand is one of the predetermined qualifying hands, then the two hands push and the Player's wager neither wins nor loses; if the Player's hand ranks higher than the Banker's and the Banker's hand is one of the predetermined qualifying hands, the Player's wager wins and is paid either Even Money (1 to 1) or according to a predetermined pay table, whichever is chosen for this Poker Bet.

Rules 4: If the Banker's hand is not one of the predetermined qualifying hands, the Player's Poker Bet wager wins and is paid one half of the wager (1 to 2) even the Player's hand ranks lower than the Banker's; if the Player's hand ranks the same as or ranks lower than the Banker's and the Banker's hand is one of the predetermined qualifying hands, the Player's wager loses; if the Player's hand ranks higher than the Banker's and the Banker's hand is one of the predetermined qualifying hands, the Player's wager wins and is paid either Even Money (1 to 1) or according to a predetermined pay table, whichever is chosen for this Poker Bet.

Rules 5: If the Banker's hand is not a qualifying hand of King-high or better (i.e. K9876 is a hand of King-high and 22AQJ is a better hand than the King-high hand), or if the Player's hand ranks the same as the Banker's, then the Player's Poker Bet wager is a push and neither wins nor loses; if the Player's hand ranks lower than the Banker's and the Banker's hand is a qualifying hand of King-high or better, the Player's wager loses; if the Player's hand ranks higher than the Banker's and the Banker's hand is a qualifying hand of King-high or better, the Player's wager wins and is paid Even Money (1 to 1).

Rules 6: If the Banker's hand is 'not' one of the predetermined qualifying hands, or if the Player's hand ranks the same as the Banker's, then the Player's Poker Bet wager is a push and neither wins nor loses; if the Player's hand ranks lower than the Banker's and the Banker's hand is one of the predetermined qualifying hands, the Player's wager loses; if the Player's hand ranks higher than the Banker's and the Banker's hand is one of the predetermined qualifying hands, the Player's wager wins and is paid either Even Money (1 to 1) or according to a predetermined pay table, whichever is chosen for this Poker Bet.

Rules 7: If the Banker's hand is 'not' one of the predetermined qualifying hands, then the Player's Poker Bet wager is a push and the Player's wager neither wins nor loses; if the Player's hand ranks the same as or ranks lower than the Banker's and the Banker's hand is one of the predetermined qualifying hands, the Player's wager loses; if the Player's hand ranks higher than the Banker's and the Banker's hand is one of the predetermined qualifying hands, the Player's wager wins and is paid either Even Money (1 to 1) or according to a predetermined pay table, whichever is chosen for this Poker Bet.

Rules 8: If the Banker's hand is 'not' one of the predetermined qualifying hands, then the Player's Poker Bet wager is a push and neither wins nor loses; if the Player's hand ranks lower than the Banker's and the Banker's hand is one of the predetermined qualifying hands, the Player's wager loses; if the Player's hand ranks higher than or ranks the same as the Banker's and the Banker's hand is one of the predetermined qualifying hands, the Player's wager wins and is paid either Even Money (1 to 1) or according to a predetermined pay table, whichever is chosen for this Poker Bet.

Rules 9: If the Player's hand ranks lower than the Banker's, the Player's Poker Bet wager loses; if the Player's hand ranks the same as the Banker's, then the two hands push and the Player's wager neither wins nor loses; if the Player's hand ranks higher than the Banker's, the Player's wager wins and is paid according to a predetermined pay table.

Rules 10: If the Player's hand ranks the same as or ranks lower than the Banker's, the Player's Poker Bet wager loses; if the Player's hand ranks higher than the Banker's, the Player's wager wins and is paid according to a predetermined pay table.

Rules 11: If the Player's hand ranks lower than the Banker's, the Player's Pokwe Bet wager loses; if the Player's hand ranks higher than or ranks the same as the Banker's, the Player's wager wins and is paid according to a predetermined pay table.

Rules 12: If the Player's hand ranks lower than the Banker's, the Player's Poker Bet wager loses; if the Player's hand ranks the same as the Banker's, then the two hands push and the Player's wager neither wins nor loses; if the Player's hand ranks higher than the Banker's, the Player's wager wins and is paid Even Money (1 to 1), less a certain percent commission, preferably a 5% commission.

Rules 13: If the Player's hand ranks the same as or ranks lower than the Banker's, the Player's Poker Bet wager loses; if the Player's hand ranks higher than the Banker's, the Player's wager wins and is paid Even Money (1 to 1), less a certain percent commission, preferably a 5% commission.

Rules 14: If the Player's hand ranks lower than the Banker's, the Player's Poker Bet wager loses; if the Player's hand ranks higher than or ranks the same as the Banker's, the Player's wager wins and is paid Even Money (1 to 1), less a certain percent commission, preferably a 5% commission.

Rules 15: If the Player's hand ranks lower than the Banker's, the Player's Poker Bet wager loses; if the Player's hand ranks higher than or ranks the same as the Banker's, the Player's wager wins, and either is paid Even Money (1 to 1) if the Banker's losing hand is 'not' King-Jack or lower, or is paid one half of the wager (1 to 2) if the Banker's losing hand is King-Jack or lower.

Rules 16: If the Player's hand ranks lower than the Banker's, the Player's Poker Bet wager loses; if the Player's hand ranks higher than or ranks the same as the Banker's, the Player's wager wins, and either is paid either Even Money (1 to 1) or according to a predetermined pay table if the Banker's losing hand is 'not' one of the predetermined hands that pays the Player's winning Poker Bet wager one half of the wager, or is paid one half of the wager (1 to 2) if the Banker's losing hand is one of the predetermined hands that pays the Player's winning Poker Bet wager one half of the wager.

Rules 17: If the Player's hand ranks the same as or ranks lower than the Banker's, the Player's Poker Bet wager loses; if the Player's hand ranks higher than the Banker's, the Player's wager wins, and either is paid either Even Money (1 to 1) or according to a predetermined pay table if the Banker's losing hand is 'not' one of the predetermined hands that pays the Player's winning Poker Bet wager one half of the wager, or is paid one half of the wager (1 to 2) if the Banker's losing hand is one of the predetermined hands that pays the Player's winning Poker Bet wager one half of the wager.

Rules 18: If the Player's hand ranks lower than the Banker's, the Player's Poker Bet wager loses; if the Player's hand ranks the same as the Banker's, then the two hands push and neither wins nor loses; if the Player's hand ranks higher than the Banker's, the Player's wager wins, and either is paid either Even Money (1 to 1) or according to a predetermined pay table if the Banker's losing hand is 'not' one of the predetermined hands that pays the Player's winning Poker Bet wager one half of the wager, or is paid one half of the wager (1 to 2) if the Banker's losing hand is one of the predetermined hands that pays the Player's winning Poker Bet wager one half of the wager.

PAIR OF ACES OR BETTER BET under the rules of that the Joker is 'wild' and can be used as any card. There are eleven versions of this Pair Of Aces Or Better Bet and they are:

Version 1: A Player's Pair Of Aces Or Better Bet wager wins if the Player's hand (best 5-card poker hand) is a pair of Aces, Two Pair, 3 of a Kind, Straight, Flush, Full House, 4 of a Kind, Straight Flush, Royal Flush or 5 of a Kind; and the Player's wager loses if the Player's hand is not one of the above winning hands. The Player's winning wager is paid Even Money (1 to 1) and this payout yields a house advantage of 2.29%. Alternatively, the player's winning wager may be paid according to a predetermined pay table.

Version 2: A Player's Pair Of Aces Or Better Bet wager wins if the Player's hand (best 5-card poker hand) ranks higher than the Banker's hand (best 5-card poker hand) with a pair of Aces, Two Pair, 3 of a Kind, Straight, Flush, Full House, 4 of a Kind, Straight Flush, Royal Flush or 5 of a Kind, and is paid according to either a predetermined payoff odds or a predetermined pay table, whichever is chosen; the Player's wager loses if the Player's hand ranks lower than or ranks the same as the Banker's, or if the Player's hand ranks higher than the Banker's with a pair of Kings or lower.

Version 3: A Player's Pair Of Aces Or Better Bet wager wins if the Player's hand ranks higher than the Banker's with a pair of Aces, Two Pair, 3 of a Kind, Straight, Flush, Full House, 4 of a Kind, Straight Flush, Royal Flush or 5 of a Kind, and is paid according to either a predetermined payoff odds or a predetermined pay table, whichever is chosen; the Player's wager is a push and neither wins nor loses if the Player's hand ranks the same as the Banker's with a pair of Aces or better; the Player's wager loses if the Player's hand ranks lower than the Banker's, or if the Player's hand ranks higher than ranks the same as the Banker's with a pair of Kings or lower.

Version 4: A Player's Pair Of Aces Or Better Bet wager wins if the Player's hand ranks higher than or ranks the same as the Banker's with a pair of Aces, Two Pair, 3 of a Kind, Straight, Flush, Full House, 4 of a Kind, Straight Flush, Royal Flush or 5 of a Kind, and is paid either Even Money (1 to 1) or according to a predetermined pay table, whichever is chosen; the Player's wager loses if the Player's hand ranks lower than the Banker's or if the Player's hand ranks higher than or ranks the same as the Banker's with a pair of Kings or lower.

Version 5: A Player's Pair Of Aces Or Better Bet wager wins if the Player's hand ranks higher than the Banker's with a pair of Aces, Two Pair, 3 of a Kind, Straight, Flush, Full House, 4 of a Kind, Straight Flush, Royal Flush or 5 of a Kind, and is paid according to either a predetermined payoff odds or a predetermined pay table; the Player's wager is a push and neither wins nor loses if the Player's hand ranks the same as the Banker's; the Player's wager loses if the Player's hand ranks lower than the Banker's or if the Player's hand ranks higher than the Banker's with a pair of Kings or lower.

Version 6: A Player's Pair Of Aces Or Better Bet wager wins if the Player's hand ranks higher than the Banker's with a pair of Aces, Two Pair, 3 of a Kind, Straight, Flush, Full House, 4 of a Kind, Straight Flush, Royal Flush or 5 of a Kind, or if the Player's hand ranks the same as the Banker's, and is paid according to either a predetermined payoff odds or a predetermined pay table; the Player's wager loses if the Player's hand ranks lower than the Banker's or if the Player's hand ranks higher than the Banker's with a pair of Kings or lower.

Version 7: A Player's Pair Of Aces Or Better Bet wager wins if the Player is dealt a 7-Card Straight Flush or if the Player's hand (best 5-card poker hand) ranks higher than the Banker's hand (best 5-card poker hand) with a pair of Aces, Two Pair, 3 of a Kind, Straight, Flush, Full House, 4 of a Kind, Straight Flush, Royal Flush or 5 of a Kind, and is paid according to either a predetermined payoff odds or a predetermined pay table; the Player's wager loses if the Player's hand ranks lower than or ranks the same as the Banker's or if the Player's hand ranks higher than the Banker's with a pair of Kings or lower.

Version 8: A Player's Pair Of Aces Or Better Bet wager wins if the Player is dealt a 7-Card Straight Flush or if the Player's hand ranks higher than the Banker's with a pair of Aces, Two Pair, 3 of a Kind, Straight, Flush, Full House, 4 of a Kind, Straight Flush, Royal Flush or 5 of a Kind, and is paid according to either a predetermined payoff odds or a predetermined pay table; the Player's wager is a push and neither wins nor loses if the Player's hand ranks the same as the Banker's with a pair of Aces or better; the Player's wager loses if the Player's hand ranks lower than the Banker's, or if the Player's hand ranks higher than or ranks the same as the Banker's with a pair of Kings or lower.

Version 9: A Player's Pair Of Aces Or Better Bet wager wins if the Player is dealt a 7-Card Straight Flush or if the Player's hand ranks higher than or ranks the same as the Banker's with a pair of Aces, Two Pair, 3 of a Kind, Straight, Flush, Full House, 4 of a Kind, Straight Flush, Royal Flush or 5 of a Kind, and is paid according to either a predetermined payoff odds or a predetermined pay table; the Player's wager loses if the Player's hand ranks lower than the Banker's, or if the Player's hand ranks higher than or ranks the same as the Banker's with a pair of Kings or lower.

Version 10: A Player's Pair Of Aces Or Better Bet wager wins if the Player is dealt a 7-Card Straight Flush or if the Player's hand ranks higher than the Banker's with a pair of Aces, Two Pair, 3 of a Kind, Straight, Flush, Full House, 4 of a Kind, Straight Flush, Royal Flush or 5 of a Kind, and is paid according to either a predetermined payoff odds or a predetermined pay table; the Player's wager is a push and neither wins nor loses if the Player's hand ranks the same as the Banker's; the Player's wager loses if the Player's hand ranks lower than the Banker's or if the Player's hand ranks higher than the Banker's with a pair of Kings or lower.

Version 11: A Player's Pair Of Aces Or Better Bet wager wins if the Player is dealt a 7-Card Straight Flush, or if the Player's hand ranks higher than the Banker's with a pair of Aces, Two Pair, 3 of a Kind, Straight, Flush, Full House, 4 of a Kind, Straight Flush, Royal Flush or 5 of a Kind, or if the Player's hand ranks the same as the Banker's, and is paid according to either a predetermined payoff odds or a predetermined pay table; the Player's wager loses if the Player's hand ranks lower than the Banker's or if the Player's hand ranks higher than the Banker's with a pair of Kings or lower.

PAIR OF ACES OR BETTER BET under the rules of that the Joker is 'semi-wild' and can be used as an Ace or to complete a Straight or Flush. There are eleven versions of this Pair Of Aces Or Better Bet and they are:

Version 1: A Player's Pair Of Aces Or Better Bet wager wins if the Player's hand is a pair of Aces, Two Pair, 3 of a Kind, Straight, Flush, Full House, 4 of a Kind, Straight Flush, Royal Flush or 5 Aces; and the Player's wager loses if the Player's hand is not one of the above winning hands. The player's winning wager can be paid according to a predetermined payoff odds, a predetermined pay table, or any one of the following three pay tables, whichever is chosen for this Pair Of Aces Or Better Bet:

| Hand | Payout Odds |
|---|---|
| Pay Table A: | |
| Two Pair or Better | 1 to 1 |
| Two or More Aces | 1½ to 1 |
| Pay Table A yields a house advantage of 1.81%. | |
| Pay Table B: | |
| 5 Aces | 50 to 1 |
| Royal Flush | 20 to 1 |
| Straight Flush | 7 to 1 |
| 4 of a Kind | 6 to 1 |
| Full House | 2 to 1 |
| Aces through Flush | 1 to 1 |
| Pay Table B yields a house advantage of 2.77%. | |
| Pay Table C: | |
| 5 Aces | 100 to 1 |
| Royal Flush | 20 to 1 |
| Straight Flush | 7 to 1 |
| 4 of a Kind | 6 to 1 |
| Full House | 2 to 1 |
| Aces through Flush | 1 to 1 |
| Pay Table C yields a house advantage of 2.73%. | |

Version 2: A Player's Pair Of Aces Or Better Bet wager wins if the Player's hand ranks higher than the Banker's with a pair of Aces, Two Pair, 3 of a Kind, Straight, Flush, Full House, 4 of a Kind, Straight Flush, Royal Flush or 5 Aces and is paid according to either a predetermined payoff odds or a predetermined pay table; the Player's wager loses if the Player's hand ranks lower than or ranks the same as the Banker's, or if the Player's hand ranks higher than the Banker's with a pair of Kings or lower.

Version 3: A Player's Pair Of Aces Or Better Bet wager wins if the Player's hand ranks higher than the Banker's with a pair of Aces, Two Pair, 3 of a Kind, Straight, Flush, Full House, 4 of a Kind, Straight Flush, Royal Flush or 5 Aces and is paid according to either a predetermined payoff odds or a predetermined pay table; the Player's wager is a push and neither wins nor loses if the Player's hand ranks the same as the Banker's with a pair of Aces or better; the Player's wager loses if the Player's hand ranks lower than the Banker's, or if the Player's hand ranks higher than or ranks the same as the Banker's with a pair of Kings or lower.

Version 4: A Player's Pair Of Aces Or Better Bet wager wins if the Player's hand ranks higher than or ranks the same as the Banker's with a pair of Aces, Two Pair, 3 of a Kind, Straight, Flush, Full House, 4 of a Kind, Straight Flush, Royal Flush or 5 Aces, and is paid according to either a predetermined payoff odds or a predetermined pay table; the Player's wager loses if the Player's hand ranks lower than the Banker's, or if the Player's hand ranks higher than or ranks the same as the Banker's with a pair of Kings or lower.

Version 5: A Player's Pair Of Aces Or Better Bet wager wins if the Player's hand ranks higher than the Banker's with a pair of Aces, Two Pair, 3 of a Kind, Straight, Flush, Full House, 4 of a Kind, Straight Flush, Royal Flush or 5 Aces and is paid according to either a predetermined payoff odds or a predetermined pay table; the Player's wager is a push and neither wins nor loses if the Player's hand ranks the same as the Banker's; the Player's wager loses if the Player's hand ranks lower than the Banker's or if the Player's hand ranks higher than the Banker's with a pair of Kings or lower.

Version 6: A Player's Pair Of Aces Or Better Bet wager wins if the Player's hand ranks higher than the Banker's with a pair of Aces, Two Pair, 3 of a Kind, Straight, Flush, Full House, 4 of a Kind, Straight Flush, Royal Flush or 5 of a Kind, or if the Player's hand ranks the same as the Banker's, and is paid according to either a predetermined payoff odds or a predetermined pay table; the Player's wager loses if the Player's hand ranks lower than the Banker's or if the Player's hand ranks higher than the Banker's with a pair of Kings or lower.

Version 7: A Player's Pair Of Aces Or Better Bet wager wins if the Player is dealt a 7-Card Straight Flush or if the Player's hand ranks higher than the Banker's with a pair of Aces, Two Pair, 3 of a Kind, Straight, Flush, Full House, 4 of a Kind, Straight Flush, Royal Flush or 5 Aces and is paid according to either a predetermined payoff odds or a predetermined pay table; the Player's wager loses if the Player's hand ranks lower than or ranks the same as the Banker's, or if the Player's hand ranks higher than the Banker's with a pair of Kings or lower.

Version 8: A Player's Pair Of Aces Or Better Bet wager wins if the Player is dealt a 7-Card Straight Flush or if the Player's hand ranks higher than the Banker's with a pair of Aces, Two Pair, 3 of a Kind, Straight, Flush, Full House, 4 of a Kind, Straight Flush, Royal Flush or 5 Aces and is paid according to either a predetermined payoff odds or a predetermined pay table; the Player's wager is a push and neither wins nor loses if the Player's hand ranks the same as the Banker's with a pair of Aces or better; the Player's wager loses if the Player's hand ranks lower than the Banker's, or if the Player's hand ranks higher than or ranks the same as the Banker's with a pair of Kings or lower.

Version 9: A Player's Pair Of Aces Or Better Bet wager wins if the Player is dealt a 7-Card Straight Flush or if the Player's hand ranks higher than or ranks the same as the Banker's with a pair of Aces, Two Pair, 3 of a Kind, Straight, Flush, Full House, 4 of a Kind, Straight Flush, Royal Flush or 5 Aces, and is paid according to either a predetermined payoff odds or a predetermined pay table; the Player's wager loses if the Player's hand ranks lower than the Banker's, or if the Player's hand ranks higher than or ranks the same as the Banker's with a pair of Kings or lower.

Version 10: A Player's Pair Of Aces Or Better Bet wager wins if the Player is dealt a 7-Card Straight Flush or if the Player's hand ranks higher than the Banker's with a pair of Aces, Two Pair, 3 of a Kind, Straight, Flush, Full House, 4 of a Kind, Straight Flush, Royal Flush or 5 Aces and is paid according to either a predetermined payoff odds or a predetermined pay table; the Player's wager is a push and neither wins nor loses if the Player's hand ranks the same as the Banker's; the Player's wager loses if the Player's hand ranks lower than the Banker's or if the Player's hand ranks higher than the Banker's with a pair of Kings or lower.

Version 11: A Player's Pair Of Aces Or Better Bet wager wins if the Player is dealt a 7-Card Straight Flush, or if the Player's hand ranks higher than the Banker's with a pair of Aces, Two Pair, 3 of a Kind, Straight, Flush, Full House, 4 of a Kind, Straight Flush, Royal Flush or 5 of a Kind, or if the Player's hand ranks the same as the Banker's, and is paid according to either a predetermined payoff odds or a predetermined pay table; the Player's wager loses if the Player's hand ranks lower than the Banker's or if the Player's hand ranks higher than the Banker's with a pair of Kings or lower.

BONUS BET under the rules that the Joker is 'wild' and can be used as any card. There are ten versions of this Bonus Bet and they are:

Version 1: A Player's Bonus Bet wager wins if the Player is dealt a 7-Card Straight Flush or if the Player's hand (best 5-card poker hand) ranks higher than the Banker's hand (best 5-card poker hand) with Flush or better (Full House, 4 of a Kind, Straight Flush, Royal Flush or 5 of a Kind); and the Player's wager loses if the Player's hand ranks the same as or ranks lower than the Banker's or if the Player's hand ranks higher than the Banker's hand with Straight or lower; the Player's winning wager is paid according to either a predetermined payout odds, a predetermined pay table, or either one of the following two pay tables, whichever is chosen for this Bonus Bet:

| Hand | Payout Odds |
|---|---|
| Pay Table One: | |
| 7 Card Straight Flush With No Joker | 20,000 to 1 |
| 7 Card Straight Flush With Joker | 5,000 to 1 |
| 5 of a Kind | 500 to 1 |
| Royal Flush | 400 to 1 |
| Straight Flush | 75 to 1 |
| 4 of a Kind | 30 to 1 |
| Full House | 4 to 1 |
| Flush | 3 to 1 |
| Pay Table One yields a house advantage of 22.27%. | |
| Pay Table Two: | |
| 7 Card Straight Flush With No Joker | 10,000 to 1 |
| 7 Card Straight Flush With Joker | 5,000 to 1 |
| 5 of a Kind | 500 to 1 |
| Royal Flush | 400 to 1 |
| Straight Flush | 75 to 1 |
| 4 of a Kind | 30 to 1 |
| Full House | 4 to 1 |
| Flush | 3 to 1 |
| Pay Table Two yields a house advantage of 22.46%. | |

Version 2: A Player's Bonus Bet wager wins if the Player is dealt a 7-Card Straight Flush or if the Player's hand ranks higher than or ranks the same as the Banker's with Flush or better; and the Player's wager loses if the Player's hand ranks lower than the Banker's hand or if the Player's hand ranks higher than or ranks the same as the Banker's with Straight or lower; the Player's winning wager is paid according to either a predetermined pay table or a predetermined payout odds, whichever is chosen for this Bonus Bet.

Version 3: A Player's Bonus Bet wager wins if the Player is dealt a 7-Card Straight Flush or if the Player's hand ranks higher than the Banker's with Flush or better, and is paid according to either a predetermined pay table or a predetermined payout odds, whichever is chosen for this Bonus Bet; the Player's wager is a push and neither wins nor loses if the Player's hand ranks the same as the Banker's with Flush or better; the Player's wager loses if the Player's hand ranks lower than the Banker's, or if the Player's hand ranks higher than or ranks the same as the Banker's with Straight or lower.

Version 4: A Player's Bonus Bet wager wins if the Player is dealt a 7-Card Straight Flush or if the Player's hand ranks higher than the Banker's with Flush or better, and is paid according to either a predetermined pay table or a predetermined payout odds, whichever is chosen for this Bonus Bet; the Player's wager is a push and neither wins nor loses if the Player's hand ranks the same as the Banker's; the Player's wager loses if the Player's hand ranks lower than the Banker's or if the Player's hand ranks higher than the Banker's with Straight or lower.

Version 5: A Player's Bonus Bet wager wins if the Player is dealt a 7-Card Straight Flush or if the Player's hand ranks higher than the Banker's with Flush or better, or if the Player's hand ranks the same as the Banker's, and is paid according to either a predetermined pay table or a predetermined payout odds, whichever is chosen for this Bonus Bet; the Player's wager loses if the Player's hand ranks lower than the Banker's or if the Player's hand ranks higher than the Banker's with Straight or lower.

Version 6: A Player's Bonus Bet wager wins if the Player's hand ranks higher than the Banker's with Flush or better; and the Player's wager loses if the Player's hand ranks the same as or ranks lower than the Banker's or if the Player's hand ranks higher than the Banker's with Straight or lower; the Player's winning wager is paid according to either a predetermined pay table or a predetermined payout odds, whichever is chosen for this Bonus Bet:

Version 7: A Player's Bonus Bet wager wins if the Player's hand ranks higher than or ranks the same as the Banker's with Flush or better; and the Player's wager loses if the Player's hand ranks lower than the Banker's or if the Player's hand ranks higher than or ranks the same as the Banker's with Straight or lower; the Player's winning wager is paid according to either a predetermined pay table or a predetermined payout odds, whichever is chosen for this Bonus Bet.

Version 8: A Player's Bonus Bet wager wins if the Player's hand ranks higher than the Banker's with Flush or better, and is paid according to either a predetermined pay table or a predetermined payout odds, whichever is chosen for this Bonus Bet; the Player's wager is a push and neither wins nor loses if the Player's hand ranks the same as the Banker's with Flush or better; the Player's wager loses if the Player's hand ranks lower than the Banker's, or if the Player's hand ranks higher than or ranks the same as the Banker's with Straight or lower.

Version 9: A Player's Bonus Bet wager wins if the Player's hand ranks higher than the Banker's with Flush or better, and is paid according to either a predetermined pay table or a predetermined payout odds, whichever is chosen for this Bonus Bet; the Player's wager is a push and neither wins nor loses if the Player's hand ranks the same as the Banker's; the Player's wager loses if the Player's hand ranks lower than the Banker's or if the Player's hand ranks higher than the Banker's with Straight or lower.

Version 10: A Player's Bonus Bet wager wins if the Player's hand ranks higher than the Banker's with Flush or better, or if the Player's hand ranks the same as the Banker's, and is paid according to either a predetermined pay table or a predetermined payout odds, whichever is chosen for this Bonus Bet; the Player's wager loses if the Player's hand ranks lower than the Banker's or if the Player's hand ranks higher than the Banker's with Straight or lower.

BONUS BET under the rules that the Joker is 'semi-wild' and can be used as an Ace or to form a Straight or Flush. There are ten version of this Bonus Bet and they are:

Version 1: A Player's Bonus Bet wager wins if the Player is dealt a 7-Card Straight Flush or if the Player's hand ranks higher than the Banker's with Flush or better (Full House, 4 of a Kind, Straight Flush, Royal Flush or 5 Aces); and the Player's wager loses if the Player's hand ranks the same as or ranks lower than the Banker's, or if the Player's hand ranks higher than the Banker's with Straight or lower; the Player's winning wager is paid according to a predetermined payout odds, a predetermined pay table, or any one of the following three pay tables, whichever is chosen for this Bonus Bet:

| Hand | Payout Odds |
|---|---|
| Pay Table A: | |
| 7 Card Straight Flush With No Joker | 20,000 to 1 |
| 7 Card Straight Flush With Joker | 10,000 to 1 |
| 5 Aces | 5,000 to 1 |
| Royal Flush | 500 to 1 |
| Straight Flush | 200 to 1 |
| 4 of a Kind | 75 to 1 |
| Full House | 4 to 1 |
| Flush | 2 to 1 |
| Pay Table One yields a house advantage of 22.26%. | |
| Pay Table B: | |
| 7 Card Straight Flush | 10,000 to 1 |
| 5 Aces | 5,000 to 1 |
| Royal Flush | 500 to 1 |
| Straight Flush | 200 to 1 |
| 4 of a Kind | 75 to 1 |
| Full House | 4 to 1 |
| Flush | 2 to 1 |
| Pay Table Two yields a house advantage of 22.46%. | |
| Pay Table C: | |
| 7 Card Straight Flush | 10,000 to 1 |
| 5 Aces | 2,500 to 1 |
| Royal Flush | 400 to 1 |
| Straight Flush | 150 to 1 |
| 4 of a Kind | 75 to 1 |
| Full House | 6 to 1 |
| Flush | 3 to 1 |
| Pay Table Two yields a house advantage of 22.85%. | |

Version 2: A Player's Bonus Bet wager wins if the Player is dealt a 7-Card Straight Flush or if the Player's hand ranks higher than or ranks the same as the Banker's with Flush or better; and the Player's wager loses if the Player's hand ranks lower than the Banker's or if the Player's hand ranks higher than or ranks the same as the Banker's with Straight or lower; the Player's winning wager is paid according to either a predetermined pay table or a predetermined payout odds, whichever is chosen for this Bonus Bet.

Version 3: A Player's Bonus Bet wager wins if the Player is dealt a 7-Card Straight Flush or if the Player's hand ranks higher than the Banker's with Flush or better, and is paid according to either a predetermined pay table or a predetermined payout odds, whichever is chosen for this Bonus Bet; the Player's wager is a push and neither wins nor loses if the Player's hand ranks the same as the Banker's with Flush or better; the Player's wager loses if the Player's hand ranks lower than the Banker's or if the Player's hand ranks higher than or ranks the same as the Banker's with Straight or lower.

Version 4: A Player's Bonus Bet wager wins if the Player is dealt a 7-Card Straight Flush or if the Player's hand ranks higher than the Banker's with Flush or better, and is paid according to either a predetermined pay table or a predetermined payout odds, whichever is chosen for this Bonus Bet; the Player's wager is a push and neither wins nor loses if the Player's hand ranks the same as the Banker's; the Player's wager loses if the Player's hand ranks lower than the Banker's or if the Player's hand ranks higher than the Banker's with Straight or lower.

Version 5: A Player's Bonus Bet wager wins if the Player is dealt a 7-Card Straight Flush, or if the Player's hand ranks higher than the Banker's with Flush or better, or if the Player's hand ranks the same as the Banker's, and is paid according to either a predetermined pay table or a predetermined payout odds, whichever is chosen for this Bonus Bet; the Player's wager loses if the Player's hand ranks lower than the Banker's or if the Player's hand ranks higher than the Banker's with Straight or lower.

Version 6: A Player's Bonus Bet wager wins if the Player's hand ranks higher than the Banker's with Flush or better; and the Player's wager loses if the Player's hand ranks the same as or ranks lower than the Banker's or if the Player's hand ranks higher than the Banker's with Straight or lower; the Player's winning wager is paid according to either a predetermined pay table or a predetermined payout odds, whichever is chosen for this Bonus Bet:

Version 7: A Player's Bonus Bet wager wins if the Player's hand ranks higher than or ranks the same as the Banker's with Flush or better; and the Player's wager loses if the Player's hand ranks lower than the Banker's or if the Player's hand ranks higher than or ranks the same as the Banker's with Straight or lower; the Player's winning wager is paid according to either a predetermined pay table or a predetermined payout odds, whichever is chosen for this Bonus Bet.

Version 8: A Player's Bonus Bet wager wins if the Player's hand ranks higher than the Banker's with Flush or better, and is paid according to either a predetermined pay table or a predetermined payout odds, whichever is chosen for this Bonus Bet; the Player's wager is a push and neither wins nor loses if the Player's hand ranks the same as the Banker's with Flush or better; the Player's wager loses if the Player's hand ranks lower than the Banker's, or if the Player's hand ranks higher than or ranks the same as the Banker's with Straight or lower.

Version 9: A Player's Bonus Bet wager wins if the Player's hand ranks higher than the Banker's with Flush or better, and is paid according to either a predetermined pay table or a predetermined payout odds, whichever is chosen for this Bonus Bet; the Player's wager is a push and neither wins nor loses if the Player's hand ranks the same as the Banker's; the Player's wager loses if the Player's hand ranks lower than the Banker's or if the Player's hand ranks higher than the Banker's with Straight or lower.

Version 10: A Player's Bonus Bet wager wins if the Player's hand ranks higher than the Banker's with Flush or better, or if the Player's hand ranks the same as the Banker's, and is paid according to either a predetermined pay table or a predetermined payout odds, whichever is chosen for this Bonus Bet; the Player's wager loses if the Player's hand ranks lower than the Banker's or if the Player's hand ranks higher than the Banker's with Straight or lower.

OTHER VERSIONS OF THE PRESENT INVENTION: Other versions of the present invention can be created in the following ways:

1. The present invention consists of Poker Bet only.
2. The present invention consists of Pair Of Aces Or Better Bet only.
3. The present invention consists of Bonus Bet only.
4. The present invention consists of Poker Bet and Pair Of Aces Or Better Bet.
5. The present invention consists of Poker Bet and Bonus Bet. And
6. The present invention consists of Pair Of Aces Or Better Bet and Bonus Bet.

Any one, any two, or all three of Bonus Bet, Pair Of Aces Or Better Bet and Bonus Bet can be incorporated into any other seven-card stud poker game or any seven-card draw poker game with or without some adjustments or moderations.

The present invention can be designed to play with various number of cards selected from each seven-dealt-card hand, where the rankings and the value of hands of the game are based on; i.e. the rankings and value hands of the preferred embodiment of the present invention are based the best 5 cards out of each seven-dealt-card hand. Hence, the present invention can be designed to play with the rankings and value hands of the game based on best six cards out of each seven-dealt-card hand, based on seven-card handout of seven dealt cards, or based on best four cards out of seven dealt cards.

Other card games can be created in accordance with the present invention, by applying the rules of play of the present invention or by applying the rules of play of the present invention with minor modifications to any card game that can be played with six cards per hand, eight cards per hand or, nine or more cards per hand, using at least one standard deck of 52 cards or at least one standard deck of 52 cards plus at least one Joker.

What is claimed is:

1. A method of playing a card game among a plurality of Players and a Banker, each Player wagering against the Banker, comprising the steps of:

(a) providing and shuffling at least one standard poker deck of 52 cards plus at least one Joker, wherein the Joker may be used as any card;

(b) placing either a Poker Bet wager or Pair Of Aces Or Better Bet wager, or both;

(c) placing an optional Bonus Bet wager;

(d) dealing cards, seven cards dealt either at one time or proportionally, into enough dealt hands of seven cards to provide a dealt hand for each Player and for the Banker;

(e) determining which dealt hand is assigned to each Player and which dealt hand is assigned to the Banker;

(f) from their own seven-card dealt hand, each Player and the Banker selecting and keeping their own best 5-card poker hand and discarding two other cards;

(g) determining whether each Player's Pair Of Aces Or Better Bet wager wins or loses, if any;

(h) settling each Player's Pair Of Aces Or Better wager against the Banker;

(i) determining whether each Player's Poker Bet wager wins, loses or ties, if any; wherein each Player's best 5-card poker hand is compared to the Banker's best 5-card poker hand according to the Poker Bet rankings wherein hands are ranked in descending order as follows: 5 of a Kind, Royal Flush, Straight Flush, 4 of a Kind, Full House, Flush, Straight, 3 of a Kind, Two Pair, One Pair and High Card; wherein Ace is the highest High Card, following by King, Queen, Jack, Ten, 9, 8, 7, 6, 5, 4, 3 and 2; wherein A2345 is the lowest Straight and that it is suited, A2345 is the lowest Straight Flush;

(j) settling each Player's Poker Bet wager against the Banker;

(k) determining whether each Player's Bonus Bet wager wins or loses, if any; and (l) settling each Player's Bonus Bet wager against the Banker.

2. The method of playing a card game according to claim 1, wherein a Player's Pair Of Aces Or Better Bet wager wins if the Player's best 5-card poker hand ranks higher than or ranks the same as the Banker's best 5-card poker hand with a pair of Aces, Two Pair, 3 of a Kind, Straight, Flush, Full House, 4 of a Kind, Straight Flush, Royal Flush or 5 of a Kind, and is paid according to a predetermined pay table; the Player's wager loses if the Player's hand ranks lower than the Banker's or if the Player's best 5-card poker hand ranks higher than or ranks the same as the Banker's with a pair of Kings or lower.

3. The method of playing a card game according to claim 1, wherein a Player's Pair Of Aces Or Better Bet wager wins if the Player is dealt a 7-Card Straight Flush or if the Player's best 5-card poker hand ranks higher than or ranks the same as the Banker's best 5-card poker hand with a pair of Aces, Two Pair, 3 of a Kind, Straight, Flush, Full House, 4 of a Kind, Straight Flush, Royal Flush or 5 of a Kind, and is paid according to a predetermined pay table; the Player's wager loses if the Player's best 5-card poker hand ranks lower than the Banker's or if the Player's best 5-card poker hand ranks higher than or ranks the same as the Banker's with a pair of Kings or lower.

4. The method of playing a card game according to claim 1, wherein if the Banker's best-5 card poker hand is not a qualifying hand of Ace-high or better, the Player's Poker Bet wager wins and is paid one half of the wager, namely 1 to 2; if the Player's best 5-card poker hand ranks lower than the Banker's and the Banker's best 5-card poker hand is a qualifying hand of Ace-high or better, the Player's wager loses; if the Player's best 5-card poker hand ranks higher than or ranks the same as the Banker's and the Banker's best 5-card poker hand is a qualifying hand of Ace-high or better, the Player's wager wins and is paid Even Money, namely 1 to 1.

5. The method of playing a card game according to claim 1, wherein if the Banker's best 5-card poker hand is not one of the predetermined qualifying hands, the Player's Poker Bet wager wins and is paid one half of the wager, namely 1 to 2; if the Player's best 5-card poker hand ranks lower than the Banker's and the Banker's best 5-card poker hand is one of the predetermined qualifying hands, the Player's wager loses; if the Player's best 5-card poker hand ranks higher than or ranks the same as the Banker's and the Banker's best 5-card poker hand is one of the predetermined qualifying hands, the Player's wager wins and is paid according to a predetermined pay table.

6. The method of playing a card game according to claim 1, wherein if the Banker's best 5 card poker hand is not a qualifying hand of King-high or better, or if the Player's best 5-card poker hand ranks the same as the Banker's, then the Player's Poker Bet wager is a push and neither wins nor loses; if the Player's best 5-card poker hand ranks lower than the Banker's and the Banker's best 5-card poker hand is a qualifying hand of King-high or better, the Player's wager loses; if the Player's best 5-card poker hand ranks higher than the Banker's and the Banker's best 5-card poker hand is a qualifying hand of King-high or better, the Player's wager wins and is paid Even Money (1 to 1).

7. The method of playing a card game according to claim 1, wherein if the Player's best 5-card poker hand ranks lower than the Banker's best 5-card poker hand, the Player's Poker Bet wager loses; if the Player's best 5-card poker hand ranks the same as the Banker's, then the two hands push and the Player's wager neither wins nor loses; if the Player's best 5-card poker hand ranks higher than the Banker's, the Player's wager wins and is paid according to a predetermined pay table.

8. The method of playing a card game according to claim 1, wherein if the Player's best 5-card poker hand ranks lower than the Banker's best 5-card poker hand, the Player's Poker Bet wager loses; if the Player's best 5-card poker hand ranks higher than or ranks the same as the Banker's, the Player's wager wins and either is paid Even Money, namely 1 to 1, if the Banker's losing hand is 'not' King-Jack or lower, or is paid one half of the wager, namely 1 to 2, if the Banker's losing hand is King-Jack or lower.

9. The method of playing a card game according to claim 1, wherein a Player's Bonus Bet wager wins if the Player is dealt a 7-Card Straight Flush or if the Player's best 5-card poker hand ranks higher than the Banker's best 5-card poker hand with Flush or better; and the Player's wager loses if the Player's best 5-card poker hand ranks the same as or ranks lower than the Banker's, or if the Player's best 5-card poker hand ranks higher than the Banker's with Straight or lower; the Player's winning wager is paid as follows:

| Hand | Payout Odds |
|---|---|
| 7 Card Straight Flush With No Joker | 20,000 to 1 |
| 7 Card Straight Flush With Joker | 5,000 to 1 |
| 5 of a Kind | 500 to 1 |
| Royal Flush | 400 to 1 |
| Straight Flush | 75 to 1 |
| 4 of a Kind | 30 to 1 |
| Full House | 4 to 1 |
| Flush | 3 to 1. |

10. The method of playing a card game according to claim 1, wherein a Player's Bonus Bet wager wins if the Player is dealt a 7-Card Straight Flush or if the Player's best 5-card poker hand ranks higher than or ranks the same as the Banker's with Flush or better; the Player's wager loses if the Player's best 5-card poker hand ranks lower than the Banker's or if the Player's best 5-card poker hand ranks higher than or ranks the same as the Banker's with Straight or lower; the Player's winning wager is paid a predetermined pay table.

11. A method of playing a card game among a plurality of Players and a Banker, each Player wagering against the Banker, comprising the steps of:

(a) providing and shuffling at least one standard poker deck of 52 cards plus at least one Joker, wherein the Joker is wild and may be used as any card;

(b) placing a Bonus Bet wager;

(c) dealing cards, seven cards dealt either at one time or proportionally, into enough dealt hands of seven cards to provide a dealt hand for each Player and for the Banker;

(d) determining which dealt hand is assigned to each Player and which dealt hand is assigned to the Banker;

(e) from their own seven-card dealt hand, each Player and the Banker selecting and keeping their own best 5-card poker hand and discarding two other cards;

(f) determining whether each Player's Bonus Bet wager wins or loses, wherein the Player's Bonus Bet wager wins if the Player is dealt a 7-Card Straight Flush or if the Player's best 5-card poker hand ranks higher than or ranks the same as the Banker's best 5-card poker hand with Flush or better; the Player's wager loses if the Player's best 5-card poker hand ranks lower than the Banker's or if the Player's best 5-card poker hand ranks higher than or ranks the same as the Banker's with Straight or lower; the Player's winning wager is paid a predetermined pay table; and (l) settling each Player's wager against the Banker.

12. A method of playing a card game among a plurality of Players and a Banker, each Player wagering against the Banker, comprising the steps of:

(a) providing and shuffling at least one standard poker deck of 52 cards plus at least one Joker, wherein the Joker may be used as an Ace or to form a Straight or Flush;

(b) placing either a Poker Bet wager or Pair Of Aces Or Better Bet wager, or both;

(c) placing an optional Bonus Bet wager;

(d) dealing cards, seven cards dealt either at one time or proportionally, into enough dealt hands of seven cards to provide a dealt hand for each Player and for the Banker;

(e) determining which dealt hand is assigned to each Player and which dealt hand is assigned to the Banker;

(f) from their own seven-card dealt hand, each Player and the Banker selecting and keeping their own best 5-card poker hand and discarding two other cards;

(g) determining whether each Player's Pair Of Aces Or Better Bet wager wins or loses, if any;

(h) settling each Player's Pair Of Aces Or Better wager against the Banker;

(i) determining whether each Player's Poker Bet wager wins, loses or ties, if any; wherein each Player's best 5-card poker hand is compared to the Banker's best 5-card poker hand according to the Poker Bet rankings wherein hands are ranked in descending order as follows: 5 Aces, Royal Flush, Straight Flush, 4 of a Kind, Full House, Flush, Straight, 3 of a Kind, Two Pair, One Pair and High Card; wherein Ace is the highest High Card, following by King, Queen, Jack, Ten, 9, 8, 7, 6, 5, 4, 3 and 2; wherein A2345 is the second highest Straight and that it is suited, A2345 is the second highest Straight Flush;

(j) settling each Player's Poker Bet wager against the Banker;

(l) determining whether each Player's Bonus Bet wager wins or loses, if any; and (m) settling each Player's Bonus Bet wager against the Banker.

13. The method of playing a card game according to claim 12, wherein a Player's Pair Of Aces Or Better Bet wager wins if the Player's best 5-card poker hand is a pair of Aces, Two Pair, 3 of a Kind, Straight, Flush, Full House, 4 of a Kind, Straight Flush, Royal Flush or 5 Aces; and the Player's wager loses if the Player's best 5-card poker hand is not one of said winning hands; the player's winning wager is paid as follows:

| Hand | Payout Odds |
|---|---|
| 5 Aces | 50 to 1 |
| Royal Flush | 20 to 1 |
| Straight Flush | 7 to 1 |
| 4 of a Kind | 6 to 1 |
| Full House | 2 to 1 |
| Aces through Flush | 1 to 1. |

14. The method of playing a card game according to claim 12, wherein a Player's Pair Of Aces Or Better Bet wager wins if the Player is dealt a 7-Card Straight Flush or if the Player's best 5-card poker hand ranks higher than or ranks the same as the Banker's with a pair of Aces, Two Pair, 3 of a Kind, Straight, Flush, Full House, 4 of a Kind, Straight Flush, Royal Flush or 5 Aces, and is paid according to a predetermined pay table; and the Player's wager loses if the Player's best 5-card poker hand ranks lower than the Banker's, or if the Player's best 5-card poker hand ranks higher than or ranks the same as the Banker's with a pair of Kings or lower.

15. The method of playing a card game according to claim 12, wherein if the Banker's best 5-card poker hand is not a qualifying hand of Ace-high or better, the Player's Poker Bet wager wins and is paid one half of the wager, namely 1 to 2; if the Player's best 5-card poker hand ranks lower than the Banker's and the Banker's best 5-card poker hand is a qualifying hand of Ace-high or better, the Player's wager loses; if the Player's best 5-card poker hand ranks higher than or ranks the same as the Banker's and the Banker's best 5-card poker hand is a qualifying hand of Ace-high or better, the Player's wager wins and is paid Even Money, namely 1 to 1.

16. The method of playing a card game according to claim 12, wherein if the Banker's best 5-card poker hand is not one of the predetermined qualifying hands, the Player's Poker Bet wager wins and is paid one half of the wager, namely 1 to 2; if the Player's best 5-card poker hand ranks lower than the Banker's and the Banker's best 5-card poker hand is one of the predetermined qualifying hands, the Player's wager loses; if the Player's best 5-card poker hand ranks higher than or ranks the same as the Banker's and the Banker's best 5-card poker hand is one of the predetermined qualifying hands, the Player's wager wins and is paid according to a predetermined pay table.

17. The method of playing a card game according to claim 12, wherein if the Banker's best 5-card poker hand is not a qualifying hand of King-high or better, or if the Player's best 5-card poker hand ranks the same as the Banker's, then the Player's Poker Bet wager is a push and neither wins nor loses; if the Player's best 5-card poker hand ranks lower than the Banker's and the Banker's best 5-card poker hand is a qualifying hand of King-high or better, the Player's wager loses; if the Player's best 5-card poker hand ranks higher than the Banker's and the Banker's best 5-card poker hand is a qualifying hand of King-high or better, the Player's wager wins and is paid Even Money (1 to 1).

18. The method of playing a card game according to claim 12, wherein if the Player's best 5-card poker hand ranks lower than the Banker's best 5-card poker hand, the Player's Poker Bet wager loses; if the Player's best 5-card poker hand ranks the same as the Banker's, then the two hands push and the Player's wager neither wins nor loses; if the Player's best 5-card poker hand ranks higher than the Banker's, the Player's wager wins and is paid according to a predetermined pay table.

19. The method of playing a card game according to claim 12, wherein if the Player's best 5-card poker hand ranks lower than the Banker's best 5-card poker hand, the Player's Poker Bet wager loses; if the Player's best 5-card poker hand ranks higher than or ranks the same as the Banker's, the Player's wager wins, and either is paid Even Money, namely 1 to 1, if the Banker's losing hand is 'not' King-Jack or lower, or is paid one half of the wager, namely 1 to 2, if the Banker's losing hand is King-Jack or lower.

20. The method of playing a card game according to claim 12, wherein a Player's Bonus Bet wager wins if the Player is dealt a 7-Card Straight Flush or if the Player's best 5-card poker hand ranks higher than the Banker's with Flush or better; and the Player's wager loses if the Player's best 5-card poker hand ranks the same as or ranks lower than the Banker's, or if the Player's best 5-card poker hand ranks higher than the Banker's with Straight or lower; the Player's winning wager is paid as follows:

| Hand | Payout Odds |
|---|---|
| 7 Card Straight Flush With No Joker | 20,000 to 1 |
| 7 Card Straight Flush With Joker | 10,000 to 1 |
| 5 Aces | 5,000 to 1 |
| Royal Flush | 500 to 1 |
| Straight Flush | 200 to 1 |
| 4 of a Kind | 75 to 1 |
| Full House | 4 to 1 |
| Flush | 2 to 1. |

21. The method of playing a card game according to claim 12, wherein a Player's Bonus Bet wager wins if the Player is dealt a 7-Card Straight Flush or if the Player's best 5-card poker hand ranks higher than or ranks the same as the Banker's best 5-card poker hand with Flush or better; the Player's wager loses if the Player's best 5-card poker hand ranks lower than the Banker's or if the Player's best 5-card poker hand ranks higher than or ranks the same as the Banker's with Straight or lower; the Player's winning wager is paid according to a predetermined pay table.

* * * * *